US012012753B2

(12) United States Patent
Zemler et al.

(10) Patent No.: US 12,012,753 B2
(45) Date of Patent: Jun. 18, 2024

(54) DYNAMIC, FIRE-RESISTANCE-RATED THERMALLY INSULATING AND SEALING SYSTEM HAVING A F-RATING OF A MIN. OF 120 MIN FOR USE WITH CURTAIN WALL STRUCTURES

(71) Applicant: Hilti Aktiengesellschaft, Schaan (LI)

(72) Inventors: Matthew Zemler, Corinth, TX (US); Mario Paetow, Landsberg am Lech (DE); Arndt Andresen, Lake Dallas, TX (US)

(73) Assignee: Hilti Aktiengesellschaft, Schaan (LI)

( * ) Notice: Subject to any disclaimer, the term of this patent is extended or adjusted under 35 U.S.C. 154(b) by 348 days.

(21) Appl. No.: 17/438,451

(22) PCT Filed: Mar. 2, 2020

(86) PCT No.: PCT/EP2020/055443
§ 371 (c)(1),
(2) Date: Sep. 12, 2021

(87) PCT Pub. No.: WO2020/182519
PCT Pub. Date: Sep. 17, 2020

(65) Prior Publication Data

US 2022/0154455 A1 May 19, 2022

Related U.S. Application Data

(63) Continuation of application No. 16/353,434, filed on Mar. 14, 2019, now Pat. No. 10,731,338.

(51) Int. Cl.

| | |
|---|---|
| ***E04B 1/94*** | (2006.01) |
| ***E04B 2/74*** | (2006.01) |
| ***E04B 9/08*** | (2006.01) |

(52) U.S. Cl.
CPC ..... *E04B 1/948* (2013.01); *E04B 1/947* (2013.01); *E04B 2/7411* (2013.01); *E04B 9/08* (2013.01)

(58) Field of Classification Search
CPC ..... E04B 1/948; E04B 1/947; E04B 2/7411; E04B 9/08
See application file for complete search history.

(56) References Cited

U.S. PATENT DOCUMENTS

| | | | |
|---|---|---|---|
| 4,517,779 | A | 5/1985 | Dunsworth |
| 4,649,129 | A | 3/1987 | Dunsworth |

(Continued)

FOREIGN PATENT DOCUMENTS

| | | |
|---|---|---|
| EP | 3 246 480 | 11/2017 |
| JP | 2017218738 | 12/2017 |

OTHER PUBLICATIONS

International Search Report dated Jun. 4, 2020 in PCT/EP2020/055443, 3 pages.

(Continued)

*Primary Examiner* — Andrew J Triggs
(74) *Attorney, Agent, or Firm* — Grüneberg and Myers PLLC

(57) ABSTRACT

Described is an approved dynamic construction for effectively thermally insulating and sealing of a safing slot between a floor of a building and an exterior wall construction wherein the exterior wall construction comprises a curtain wall configuration defined by an interior wall surface. The dynamic, thermally insulating and sealing system comprises a tubular sealing element having wing-like connection areas for attaching the tubular sealing element to the curtain wall construction and the floor of a building, to maintain thermally insulating and sealing of the safing slot during exposure to fire and heat as well as movement in order to maintain a complete seal extending across the safing (Continued)

slot and to enhance the water-stopping properties of the insulation and seal within the safing slot.

19 Claims, 6 Drawing Sheets

(56) References Cited

U.S. PATENT DOCUMENTS

| | | | | |
|---|---|---|---|---|
| 4,866,898 | A | 9/1989 | LaRoche et al. | |
| 5,502,937 | A | 4/1996 | Wilson | |
| 5,765,332 | A * | 6/1998 | Landin | E04B 1/948 52/235 |
| 8,464,485 | B2 | 6/2013 | Hilburn | |
| 8,572,914 | B2 | 11/2013 | Burgess | |
| 8,683,763 | B2 | 4/2014 | Shriver | |
| 8,782,977 | B2 * | 7/2014 | Burgess | E04B 2/7409 52/235 |
| 10,017,939 | B2 | 7/2018 | Andresen | |
| 10,202,759 | B2 | 2/2019 | Andresen et al. | |
| 10,538,915 | B1 | 1/2020 | Zemler et al. | |
| 10,731,338 | B1 * | 8/2020 | Zemler | E04B 1/947 |
| 11,035,121 | B2 | 6/2021 | Klein et al. | |
| 11,060,280 | B2 * | 7/2021 | Zemler | E04B 1/947 |
| 2003/0077419 | A1 | 4/2003 | Arndt et al. | |
| 2012/0180414 | A1 | 7/2012 | Burgess | |
| 2013/0097948 | A1 * | 4/2013 | Burgess | E04B 2/7409 52/232 |
| 2017/0130450 | A1 | 5/2017 | Witherspoon | |
| 2018/0258634 | A1 | 9/2018 | Schulz-Hanke et al. | |
| 2018/0334799 | A1 * | 11/2018 | Andresen | E04B 1/7616 |
| 2019/0063064 | A1 | 2/2019 | Paetow et al. | |
| 2019/0071865 | A1 | 3/2019 | Andresen et al. | |
| 2020/0332525 | A1 | 10/2020 | Klein et al. | |
| 2022/0154455 | A1 * | 5/2022 | Zemler | E04B 2/96 |

OTHER PUBLICATIONS

Written Opinion dated Jun. 4, 2020 in PCT/EP2020/055443, 5 pages.

U.S. Appl. No. 17/438,457, filed Sep. 12, 2021, Zemler et al.

U.S. Appl. No. 17/438,459, filed Sep. 12, 2021, Ober et al.

* cited by examiner

DYNAMIC, FIRE-RESISTANCE-RATED THERMALLY INSULATING AND SEALING SYSTEM HAVING A F-RATING OF A MIN. OF 120 MIN FOR USE WITH CURTAIN WALL STRUCTURES

CROSS-REFERENCE TO RELATED APPLICATIONS

This application is the National Stage entry under § 371 of International Application No. PCT/EP2020/055443, filed on Mar. 2, 2020, and which claims the benefit of priority to U.S. application Ser. No. 16/353,434, filed on Mar. 14, 2019. The content of each of these applications is hereby incorporated by reference in its entirety.

BACKGROUND OF THE INVENTION

Field of the Invention

The present invention relates to the field of constructions, assemblies and systems designed to thermally and acoustically insulate and seal a safing slot area defined between a curtain wall and the individual floors of a building. In particular, the present invention relates to a dynamic, fire-resistance-rated thermally insulating and sealing system having a F-Rating of a min. of 120 min for use with curtain wall structures having the a common curtain wall design including foil-faced curtain wall insulation, a steel back pan design or which include glass, especially vision glass extending to the finished floor level below.

Description of Related Art

Curtain walls are generally used and applied in modern building constructions and are the outer covering of said constructions in which the outer walls are non-structural, but merely keep the weather out and the occupants in. Curtain walls are usually made of a lightweight material, reducing construction costs and weight. When glass is used as the curtain wall, a great advantage is that natural light can penetrate deeper within the building.

A curtain wall generally transfers horizontal wind loads that are incident upon it to the main building structure through connections at floors or columns of the building. Curtain walls are designed to resist air and water infiltration, sway induced by wind and seismic forces acting on the building and its own dead load weight forces. Curtain walls differ from storefront systems in that they are designed to span multiple floors, and take into consideration design requirements such as thermal expansion and contraction, building sway and movement, water diversion, and thermal efficiency for cost-effective heating, cooling, and lighting in the building.

There are different types of curtain wall structures, e.g. curtain wall structures having a common curtain wall design including a foil-faced curtain wall insulation, a steel back pan design or which include glass, especially vision glass extending to the finished floor level below.

A typical curtain wall configuration comprises a profiled framework of vertical studs, so called mullions, and horizontal studs, so called transoms. The space between these profiles is filled either with glass panels within the window area or spandrel panels within the front of the floors. A common spandrel design comprises a pre-manufactured metal pan filled with insulating material. The remaining gap between spandrel and floor has to be sealed against fire, smoke and sound and withstand certain movement.

Curtain wall structures including an interior panel such as a back pan or other similar construction which can be of metal or other material extending across the interior surface of a curtain wall are common in modular designs. The interior panels of a curtain wall are generally made from a metal or insulation material which can easily bend, distort or be otherwise deformed when exposed to strong winds or elevated temperatures, such as intensive sunlight or heat, such as in the event of a fire. Bending, distorting or deforming of these interior panels can result in significant problems in attempting to maintain a complete thermal insulation and seal within the safing slots between the outer edges of the floor construction and the exterior curtain wall construction during a storm or fire. In particular, maintaining of a complete thermal insulation and seal at all time during a fire is important to prevent heat, smoke and flames from spreading from one floor to an adjacent floor. Further, it is important to prevent water infiltration as well as to inhibit water transfer within the building structures and to enhance water-tightness of the safing slot sealing system, i.e. in general it is important to enhance the water-stopping properties of the insulation and seal within the safing slot.

The gap between the floor and the interior wall surface of a curtain wall defines a safing slot, also referred to as perimeter slab edge (void) or perimeter joint, extending between the interior wall surface of the curtain wall construction and the outer edge of the floor. This safing slot is essential to slow the passage of fire and combustion gases between floors. Therefore, it is of great importance to improve fire stopping at the safing slot in order to keep heat, smoke and flames from spreading from one floor to an adjacent floor. It is important to note that the firestop at the perimeter slab edge is considered a continuation of the fire-resistance-rating of the floor slab. In general, the standard fire test method NFPA 285 provides a standardized fire test procedure for evaluating the suitability of exterior, non-load bearing wall assemblies and panels used as components of curtain wall assemblies, and that are constructed using combustible materials or that incorporate combustible components for installation on buildings where the exterior walls have to pass the NFPA 285 test.

In order to obtain certified materials, systems and assemblies used for structural fire-resistance and separation of adjacent spaces to safeguard against the spread of fire and smoke within a building and the spread of fire to or from the building, the International Building Code IBC 2012 provides minimum requirements to safeguard the public health, safety and general welfare of the occupants of new and existing buildings and structures. According to the International Building Code IBC 2012 Section 715.4, voids created at the intersection of the exterior curtain wall assemblies and such floor assemblies shall be sealed with an approved system to prevent the interior spread of fire where fire-resistance-rated floor or floor/ceiling assemblies are required. Such systems shall be securely installed and tested in accordance with ASTM E 2307 to provide an F-rating for a time period at least equal to the fire-resistance-rating of the floor assembly.

However, there is a code exception that states that voids created at the intersection of the exterior curtain wall assemblies and such floor assemblies, where the vision glass extends to the finished floor level, shall be permitted to be sealed with an approved material to prevent interior spread of fire. Such material shall be securely installed and capable of preventing the passage of flame and hot gasses sufficient to ignite cotton waste when subjected to ASTM E 119 time-temperature fire conditions under a minimum positive pressure differential of 0.01 inch of water column for the time period at least equal to the fire-resistance-rating of the floor assembly.

Although some glass and frame technologies have been developed that are capable of passing applicable fire test and building code requirements, there is hardly any system that addresses the exception stated in the International Building Code IBC 2012 Section 715.4 and fulfills the code section ASTM E 2307 full-scale testing. There are very few complicated curtain wall systems known that address above mentioned exception and at the same time comply with the requirements according to ASTM Designation: E 1399-97 (Reapproved 2005), in particular having a movement classification of class IV. Class IV is a combination of thermal, wind, sway and seismic movement types. These have been tested according to the invention in both horizontal and vertical conditions. The E 1399, Standard Test Method for Cyclic Movement and Measuring the Minimum and Maximum Joint Widths of Architectural Joint Systems, is used for simulation of movements of the ground, such as for example an earthquake, or even movements under high wind load or life load.

However, there is no system known that is used in a curtain wall structure that provides additionally a dynamic system complying with ASTM E 1399, such as for example a curtain wall structure defined by an interior wall surface, which includes an interior panel, such as a back pan, extending over the interior surface thereof and at least one floor spatially disposed from the inner wall surface, thereby sealing of the safing slot between the floor and the back pan of this curtain wall, which extends between the interior wall surface of the interior panel and the outer edge of the floor, in particular when vision glass is employed. Said safing slot is needed to compensate dimensional tolerances of the concreted floor and to allow movement between the floor and the façade element caused by load, such by life, seismic or wind load.

Further, there are a lot of sealing systems known that use only mineral wool for isolating purposes. However, mineral wool itself is not watertight and has to be coated or otherwise impregnated before employing it within a safing slot of a curtain wall structure to prevent water infiltration as well as to inhibit water transfer within the building structures and to enhance water-tightness of the safing slot sealing system. Therefore, there is a need for alternative safing slot filling system, which addresses the above and hence, enhances the water-stopping properties of the insulation and seal within the safing slot.

Due to the increasingly strict requirements regarding fire-resistance as well as horizontal and vertical movement, there is a need for a dynamic, thermally and acoustically insulating and sealing system for a curtain wall structure that is capable of meeting or exceeding existing fire test and building code requirements and standards including existing exceptions. In particular, there is a need for systems that prevent the spread of fire when vision glass of a curtain wall structure extends to the finished floor level below even when exposed to certain movements (complying with the requirements for a class IV movement).

Moreover, there is a need for systems that improve fire-resistance as well as sound-resistance, and have, at the same time, enhanced water-stopping properties and can be easily integrated during installation of the curtain wall structure. In particular, there is a need for dynamic, fire-resistance-rated thermally insulating and sealing systems that additionally address water infiltration as well as inhibition of water transfer within the building structures and enhance the water-tightness of the safing slot sealing system.

Further, there is a need for systems that can be easily installed within a safing slot, where, for example, access is only needed from one side, implementing a one-sided application.

Still further there is a need for systems, that can be either easily employed in a stick-built exterior dynamic curtain wall façade or used during the assembling a unitized panel for use within an exterior dynamic curtain wall assembly, making it easier for the installers to install the pre-assembled curtain wall panel on the job side.

In view of the above, it is an object of the present invention to provide a dynamic, thermally insulating and sealing system for effectively thermally insulating and sealing of a safing slot within a building construction, having a curtain wall construction defined by an interior wall surface including one or more framing members and at least one floor spatially disposed from the interior wall surface of the curtain wall construction.

Still further, it is an object of the present invention to provide a full-scale ASTM E 2307 as well as ASTM E 1399 tested system for floor assemblies, especially where the vision glass extends to the finished floor level, to address the code exception, to avoid letters and engineering judgments, and to secure and provide defined/tested architectural detail for this application, in particular, by providing a tested system for fire—as well as movement-safe architectural compartmentation.

Still further, it is an object of the present invention to provide a system that can be easily installed within a safing slot, where, for example, access is only needed from one side, implementing a one-sided application.

Still further, it is an object of the present invention to provide a system that can be employed in a stick-built exterior dynamic curtain wall façade or used in assembling a unitized panel for use within an exterior dynamic curtain wall.

Still further, it is an object of the present invention to provide a system that has improved fire-resistance as well as sound-resistance, and has at the same time enhanced water-stopping properties and can be easily integrated during installation of the curtain wall structure. Further, the object is to provide a fire-resistance-rated thermally insulating and sealing system that additionally addresses water infiltration as well as inhibition of water transfer within the building structures and enhancement of water-tightness of the safing slot sealing system.

These and other objectives as they will become apparent from the ensuring description of the invention are solved by the present invention as described herein. Portions of the disclosure pertain to preferred embodiments.

SUMMARY OF THE INVENTION

In one aspect, the present invention provides a dynamic, thermally insulating and sealing system for effectively thermally insulating and sealing of a safing slot within a building construction having a curtain wall construction defined by an interior wall surface including at least one vertical and at least one horizontal framing member and at least one floor spatially disposed from the interior wall surface of the curtain wall construction defining the safing slot extending between the interior wall surface of the curtain wall construction and an outer edge of the floor, comprising a tubular sealing element comprising a thermally resistant flexible foam material for insulating and sealing, the tubular sealing element positioned in the safing slot, wherein the tubular sealing element includes a bottom side cover; a top side cover; whereby the top side cover is connected at two positions, spatially disposed from each other, to the bottom side cover; and whereby the bottom side cover and the top side cover surround the thermally resistant flexible foam material; a first connection area for attaching the tubular sealing element to the interior wall surface of the curtain wall construction; and a second connection area for attaching the tubular sealing element to the outer edge of the floor.

In another aspect, the present invention provides a building construction comprising said thermally insulating and sealing system.

In yet another aspect, the present invention provides a dynamic, thermally insulating and sealing system, wherein the dynamic, thermally insulating and sealing system is for use within a stick-built exterior dynamic curtain wall façade or in assembling a unitized panel for use within an exterior dynamic curtain wall assembly.

In yet another aspect, the present invention provides a dynamic, thermally insulating and sealing system that enhances the water-stopping properties of the insulation and seal within the safing slot.

In yet another aspect, the present invention provides a tubular sealing element for use within curtain wall constructions.

In yet another aspect, the present invention provides a dynamic, thermally insulating and sealing system, which is suitable for acoustically insulating and sealing of a safing slot of a curtain wall structure.

BRIEF DESCRIPTION OF THE FIGURES

The subject matter of the present invention is further described in more detail by reference to the following figures.

DETAILED DESCRIPTION OF THE INVENTION

Figure 1:
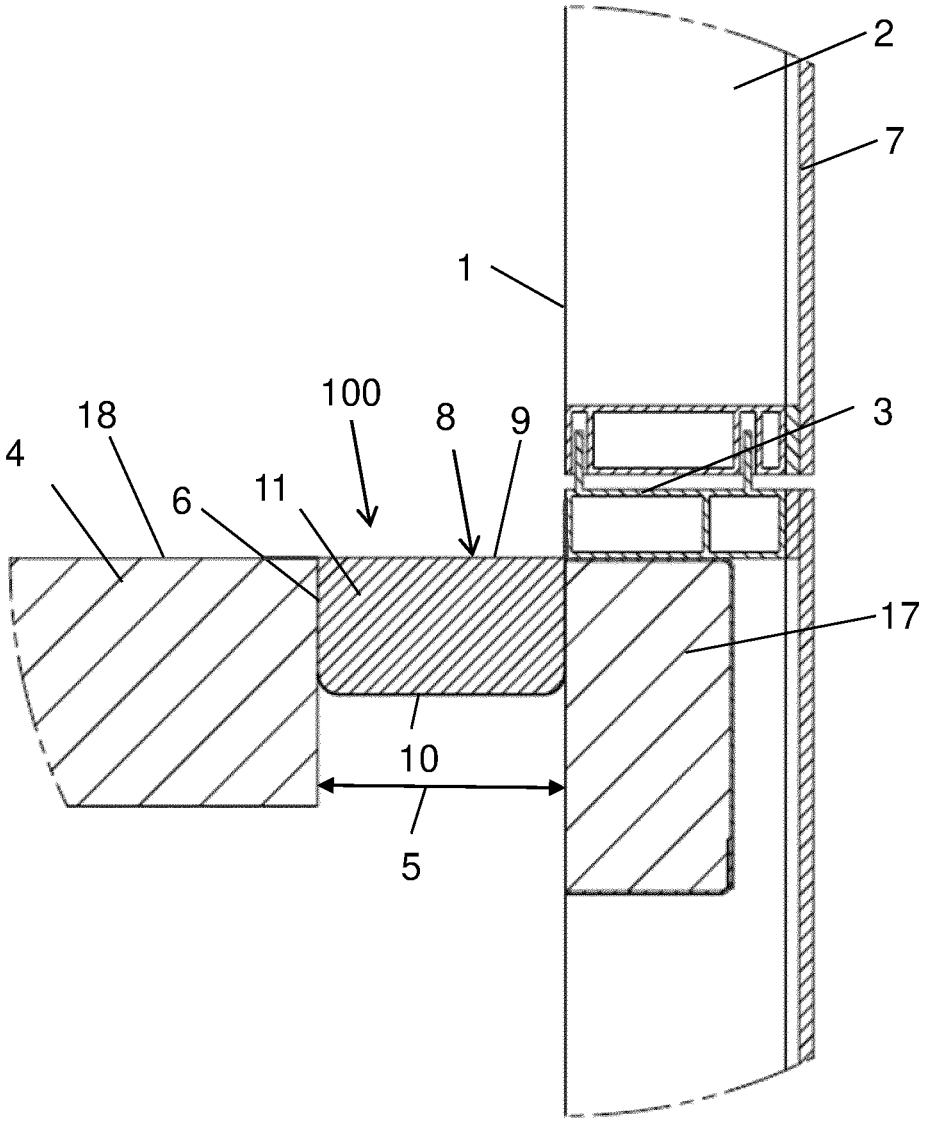
FIG. 1 shows a side cross-sectional view of an embodiment of the dynamic, thermally insulating and sealing system with the tubular sealing element arranged between the outer edge of a floor and the interior wall surface of the curtain wall construction, when initially installed and attached to a horizontal framing member (transom at floor level, i.e. zero spandrel) in a curtain wall construction, wherein the vision glass extends to the finished floor level below.
Figure 2:
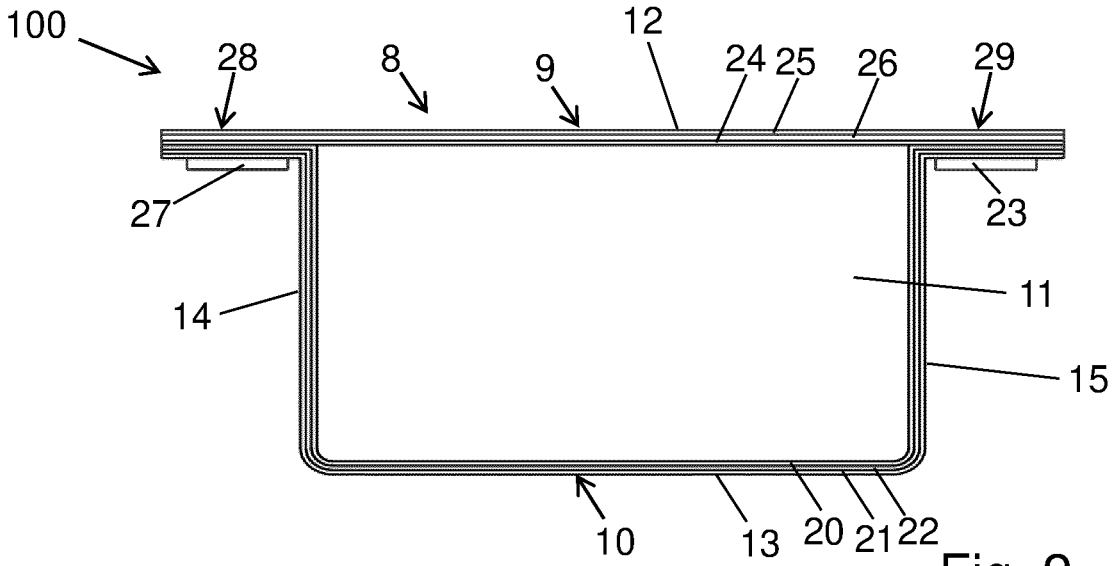
FIG. 2 shows a side cross-sectional view of the tubular sealing element, wherein the tubular sealing element has a rectangular cross section and comprises a top side laminate and a bottom side laminate.
Figure 3:
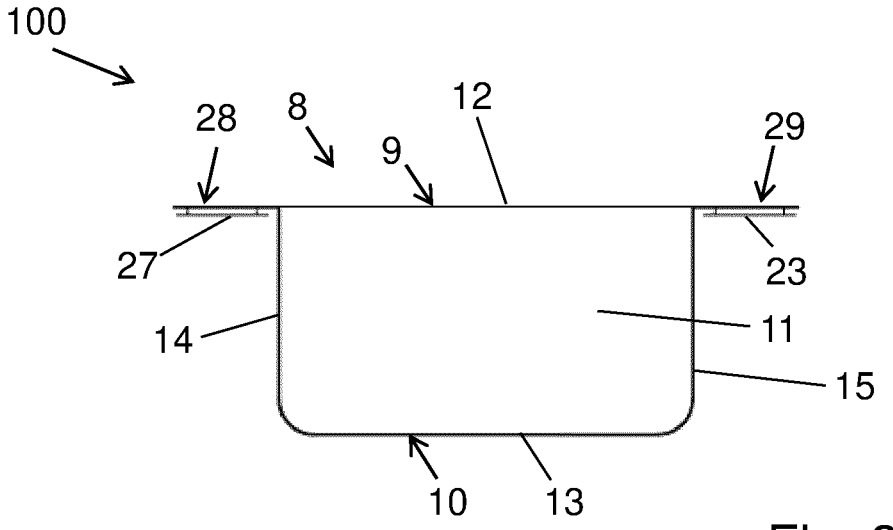
FIG. 3 shows a side cross-sectional view of another embodiment of the tubular sealing element, wherein the tubular sealing element has a rectangular cross section and comprises a top side cover and a bottom side cover.
Figure 4:
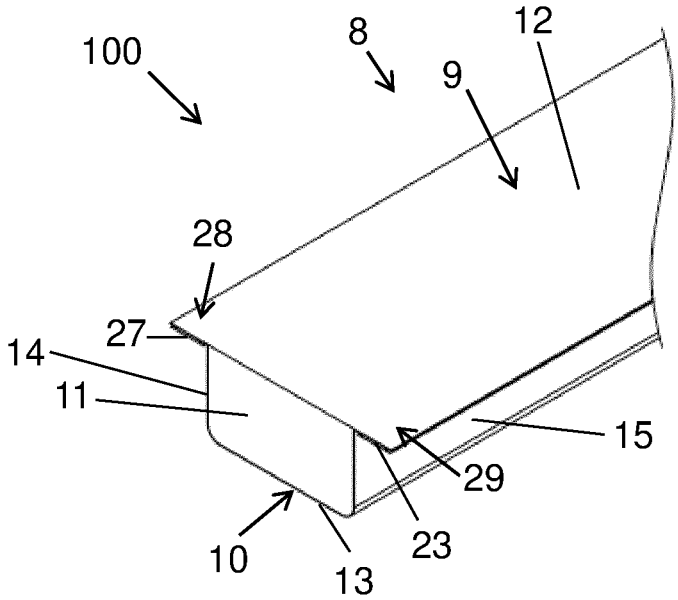
FIG. 4 shows a perspective view of the tubular sealing element of FIG. 3.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "curtain wall structure" or "curtain wall construction" in context with the present invention refers to a wall structure defined by an interior wall surface including one or more framing members and at least one floor spatially disposed from the interior wall surface of the curtain wall construction. In particular, this refers to curtain a wall structure having a common curtain wall design including foil-faced curtain wall insulation, a steel back pan design or which includes glass, especially vision glass extending to the finished floor level below.

The term "safing slot" in context with the present invention refers to the gap between a floor and the interior wall surface of the curtain wall construction as defined above; it is also referred to as "perimeter slab edge" or "perimeter joint", extending between the interior wall surface of the curtain wall construction and the outer edge of the floor.

The term "interior wall surface" in context with the present invention refers to the inner facing surface of the curtain wall construction as defined above, for example to the inner facing surface of the infilled vision glass and the inner facing surface of the framing members.

The term "connection area", also considered as an "attachment area", in context with the present invention refers to from the main body of the tubular sealing element outwardly projecting flexible wings or tabs, which constitute of parts of the bottom side cover and the top side cover (wing-like), which surround the foam material (main body). The connection areas are preferably positioned at upper corners of the main body in an area where the bottom side cover is connected to the top side cover.

The term "enhancing water-stopping properties" in context with the present invention refers to the prevention of water infiltration as well as to inhibition of water transfer within the building structures and to enhancing watertightness of the safing slot sealing system.

It has been surprisingly found out that the dynamic, thermally insulating and sealing system according to the present invention provides for a system that addresses the code exception and meets the requirements of standard method ASTM E 2307, Standard Test Method for Determining Fire Resistance of Perimeter Fire Barriers Using Intermediate-Scale, Multi-story Apparatus, 2015 as well as complies with the requirements of standard method ASTM E 1399-97 (Reapproved 2005), Standard Test Method for Cyclic Movement and Measuring the Minimum and Maximum Joint Widths of Architectural Joint Systems, addressing the horizontal as well as vertical movements resulting in a movement classification of class IV and at the same time enhances the water-stopping properties of the insulation and seal within the safing slot.

The dynamic, thermally insulating and sealing system according to the present invention is comprised of a tubular sealing element that addresses the code exception and meets the requirements of standard method ASTM E 2307 and complies with the requirements of standard method ASTM E 1399, and is described in the following:

According to the present invention, the dynamic, thermally insulating and sealing system for effectively thermally insulating and sealing of a safing slot within a building construction having a curtain wall construction defined by an interior wall surface including at least one vertical and at least one horizontal framing member and at least one floor spatially disposed from the interior wall surface of the curtain wall construction defining the safing slot extending between the interior wall surface of the curtain wall construction and an outer edge of the floor, comprises:

a tubular sealing element comprising a thermally resistant flexible foam material for insulating and sealing, the tubular sealing element positioned in the safing slot, wherein the tubular sealing element includes:

a) a bottom side cover;

b) a top side cover;

whereby the top side cover is connected at two positions, spatially disposed from each other, to the bottom side cover; and whereby the bottom side cover and the top side cover surround the thermally resistant flexible foam material;

c) a first connection area for attaching the tubular sealing element to the interior wall surface of the curtain wall construction; and d) a second connection area for attaching the tubular sealing element to the outer edge of the floor.

In particular, the tubular sealing element according to the present invention is for use with a fire-resistance rated and movement-rated curtain wall construction, wherein the curtain wall structures have a common curtain wall design including foil-faced curtain wall insulation, a steel back pan design or which include glass, especially vision glass extending to the finished floor level below. In addition, the tubular sealing element of the present invention, which can be a prefabricated product, enhances the water-stopping properties of the dynamic, thermally insulating and sealing system. In particular, the tubular sealing element when installed prevents water infiltration as well as inhibits water transfer within the building structures and enhances water-tightness of the safing slot sealing system. The tubular sealing element of the present invention comprises a thermally resistant flexible foam material for insulating and sealing, wherein the tubular sealing element is positioned in a safing slot present for example in buildings utilizing curtain wall structures having a common curtain wall design including foil-faced curtain wall insulation, a steel back pan design or which include glass.

It is preferred that the first connection area for attaching the tubular sealing element to the interior wall surface of the curtain wall construction and the second connection area for attaching the tubular sealing element to the outer edge of the floor, each constitute of parts of the bottom side cover and the top side cover, which surround the foam material. Preferably the connection areas, also referred to as flexible wings or tabs, projecting outwardly from the main body (wing-like) of the tubular sealing element. The connection areas are preferably positioned at upper corners of the main body in an area where the bottom side cover is connected to the top side cover. Most preferably, the connection areas are positioned at upper corners of the tubular sealing element having approximately squared cross-section.

It is preferred that a lower side of the first connection area is for attaching the tubular sealing element to an interior wall surface of the curtain wall construction and a lower side of the second connection area is for attaching the tubular sealing element to the top surface of the floor thereby allowing to easily mount the dynamic, thermally insulating and sealing system.

In a preferred embodiment, the tubular sealing element is placed into the safing slot such that the top side cover is flush with the top surface of the concrete floor. The tubular sealing element can be inserted in the safing slot from above or below the floor, preferably is inserted from above the floor, and the easily fixed to ensure complete seal of the safing slot.

In a preferred embodiment, the dynamic, thermally insulating and sealing system further comprises an adhesive layer positioned at the first connection area and/or the second connection area, wherein the adhesive layer may be positioned on an upper or on a lower side of the connection areas. Most preferred an adhesive layer is positioned on the lower side of the connection areas. It is preferred, that the adhesive layer is a hot-melt adhesive, a butyl sealing, a double sided adhesive or a self-adhesive layer. In a preferred embodiment of the dynamic, thermally insulating and sealing system according to the present invention, the adhesive layer, including an adhesive backer, is a hot-melt self-adhesive layer. In a most preferred embodiment, the adhesive baker is a silicone paper.

In a preferred embodiment of the tubular sealing element, the bottom side cover is a bottom side laminate. This laminate may comprise at least two layers, preferably comprises three layers. In particular, the bottom side laminate comprises a plastic foil layer, preferably comprising polyethylene, polypropylene or the like, wherein a mesh layer is laminated between the plastic foil layers, most preferably between two polyethylene foil layers. In a most preferred embodiment, the bottom side laminate is a laminate having a glass fibre mesh layer laminated between two polyethylene layers. Alternatively, the bottom side cover may also consist of one or more layers, such as layers or reinforced layers from a woven material, a woven fabric, a foil, a reinforced fiber fabric or the like, or a combination therefrom.

In a preferred embodiment of the tubular sealing element, the top side cover is a top side laminate. This laminate may comprise at least two layers, preferably comprises three layers. In particular, the top side laminate comprises an aluminum layer, a plastic foil layer, preferably comprising polyethylene, polypropylene or the like, and a mesh layer. Most preferably, the top side laminate is constituted of a reinforced aluminum layer with a polyethylene backing. Alternatively, the topside cover may also consist of one or more layers, such as layers or reinforced layers from a woven material, a woven fabric, a foil, a reinforced fiber fabric or the like, or a combination therefrom.

The bottom side cover and the top side cover can be of different or of the same materials depending on the material properties and intended function. However, it is preferred that the bottom side cover and the top side cover are of different materials.

In a particular preferred embodiment of the tubular sealing element, the mesh layer of the bottom side laminate and/or the mesh layer of the top side laminate is made of a glass fiber material or a ceramic fiber material. The fiber mesh is used to retain the foam material in place and enhance stability of the system as well as stabilizes the seal once the thermally resistant flexible foam material has been in contact with fire. The mesh layer of the bottom side laminate and/or the mesh layer of the top side laminate can be laminated between two layers of combustible foil for instance. Further, the mesh layer might be fixed or unfixed. Preferably, the mesh size of the mesh layer of the top side laminate differs from the mesh size of the mesh layer of the bottom side laminate. Preferably, the mesh sizes range in between of about 2 mm×2 mm to about 10 mm×10 mm, more preferably are about 5 mm×5 mm.

In a preferred embodiment, the thermally resistant flexible foam material is an intumescent, open-celled foam material comprising fire-protective additives having improved hydrophobic properties. Preferably, the intumescent, open-celled foam material, is a foam material based on polyurethane. It is preferred, that the thermally resistant flexible foam material has a density in uncompressed state of 90 kg/m$^3$.

According to the invention, the cross-sectional form of the tubular sealing element is generally of rectangular, trapezoidal, circular shape or U-shaped. Preferably, the cross-sectional form of the tubular sealing element is rectangular shaped. The tubular sealing element can easily be produced with different widths with regard to the cross-sectional form, for application in different safing slot widths, for example the tubular sealing element can be produced in a width of about 3.54 inches (about 90 mm) that is used for a safing slot width of 1.5 inches to 3 inches (38.1 mm-76.2 mm), a width of about 4.53 inches (about 115 mm) that is used for a safing slot width of 2 inches to 4 inches (50.8 mm to 101.6 mm), and further a width of about 5.55 inches (about 141 mm) that is used for a safing slot width of 3 inches to 5 inches (76.2 mm to 127 mm). These different sizes ease installation in that that the tubular sealing element does not need to be force-compressed into the safing slot. In an alternative embodiment with the tubular sealing element having a generally trapezoidal cross-sectional shape, a larger side of the tubular sealing element can be positioned on the curtain wall side and a smaller side of the tubular sealing element might be positioned on the floor side. For example, the tubular sealing element might have a thickness of 3.5 inches on the curtain wall side and a thickness of 2.375 inches on the floor side thereby enhancing fire-stopping. Any other dimensions for a trapezoidal shape are also feasible.

In a particular embodiment of the dynamic, thermally insulating and sealing system, the bottom side cover of the tubular sealing element comprises openings or perforations for water transfer from an inner side of the tubular sealing element to the outside in case where water has been infiltrated into the building structures and hence into the sealing element, whereas the top side cover preferably does not contain perforations or openings to prevent water entry from the top side by for example rain. In an alternative embodiment, the outer surface of the top side cover is convex.

According to the present invention, the dynamic, thermally insulating and sealing system is preferably installed in a safing slot by preferably inserting the tubular sealing element form an upper side of the floor. To install the dynamic, thermally insulating and sealing system, the following steps may be carried out in total or just parts of them:

In a first step, the width of the desired edge of slab curtain wall joint is measured. Subsequently, the measured joint width is used for determining which width of the tubular sealing element of the dynamic, thermally insulating and sealing system is suitable for the present joint width, wherein each design of a tubular sealing element has a predetermined joint width range per product. Following, the length of the curtain wall joint is measured. This length usually is taken between curtain wall anchors.

In a next step, the length of the tubular sealing element of the dynamic, thermally insulating and sealing system is measured and cut if necessary to match the needed length. If necessary, the edge of the tubular sealing element is cut to match the profile of the bracket that the tubular sealing element will be installed against and the surface of curtain wall and slab is cleaned from dust, oil, debris, and water.

Following, the tubular sealing element of the dynamic, thermally insulating and sealing system is placed on its long end and aligned on the edge of the slab. Subsequently, the tubular sealing element is compressed and rolled 90 degrees over the edge of the slab into the curtain wall joint. Once the tubular sealing element is installed flush with the upper surface of the slab, the adhesive backers on the curtain wall tape are removed and the adhesive is bonded to the curtain wall façade. Next, the adhesive backer on the slab adhesive are removed and bonded to the slab edge.

If additional pieces of the tubular sealing element of the dynamic, thermally insulating and sealing system are needed previously disclosed steps have to be repeated for the additional pieces.

Finally, each seam, splice or butt joint between adjacent tubular sealing elements and around each bracket might be sealed be applying a watertight seal just in this location to enhances the water-stopping properties of the dynamic, thermally insulating and sealing system. In particular, the watertight seal can be applied with a 2 mm wet thickness over any seams and overlapping a min. of 1 inch onto tubular sealing elements, the adjacent curtain wall assembly and concrete floor slab assembly. There is no need for applying the sealant across the whole safing slot area. Preferably, the watertight seal is in the form of an emulsion, spray, coating, foam, paint or mastic.

In other words, the tubular sealing element is continuously installed with an approximately 10% to 40% compression into the safing slot with side surface positioned in abutment with respect to the outer edge of the floor and in abutment with respect to the interior wall surface of the curtain wall construction, respectively, and with its top side cover preferably being flush to the upper surface of the floor. When installing, one or more tubular sealing elements are compressed to varying degrees, but normally compressed to approximately 10% to 40%. This compression will cause exertion of a force outwardly in order to expand outwardly to fill voids created in the safing slot. The first connection area of the tubular sealing element is attached to the interior wall surface of the curtain wall construction, wherein the first connection area is arranged essentially vertical, protruding upwardly from the tubular sealing element, and parallel to the interior wall surface of the curtain wall construction. The second connection area of the tubular sealing element is attached the upper surface of the floor, wherein the second connection area is arranged essentially horizontal, protruding outwardly from the tubular sealing element, and parallel to the upper surface of the floor making a flush connection between the top side cover and the edge of the floor.

The dynamic, thermally insulating and sealing system according to the present invention is preferably for use with a building construction defined by an interior wall surface including one or more framing members and at least one floor spatially disposed from the interior wall surface of the curtain wall construction defining the safing slot extending between the interior wall surface of the curtain wall construction and an outer edge of the floor.

In particular, the building construction comprises a dynamic, thermally insulating and sealing system for effectively thermally insulating and sealing of the safing slot, wherein the dynamic, thermally insulating and sealing system comprises:

a tubular sealing element comprising a thermally resistant flexible foam material for insulating and sealing, the tubular sealing element positioned in the safing slot, wherein the tubular sealing element includes:

a) a bottom side cover;

b) a top side cover;

whereby the top side cover is connected at two positions, spatially disposed from each other, to the bottom side cover; and whereby the bottom side cover and the top side cover surround the thermally resistant flexible foam material;

c) a first connection area for attaching the tubular sealing element to the interior wall surface of the curtain wall construction;

d) a second connection area for attaching the tubular sealing element to the outer edge of the floor; and at least one adhesive layer for fixing the tubular sealing element to the curtain wall construction.

The building construction can comprise a curtain wall construction that is comprised of a vision glass infill and at least one vertical and at least one horizontal metal framing member. Alternatively, the building construction can comprise a curtain wall construction having a common curtain wall design including foil-faced curtain wall insulation or a steel back pan design.

The dynamic, thermally insulating and sealing system according to the present invention can be used in a stick-built exterior dynamic curtain wall façade or used in assembling a unitized panel for use within an exterior dynamic curtain wall assembly. In particular, the tubular sealing element can be part of an unitized panel construction. A unitized curtain wall panel production allows the curtain wall manufacturers to install all required curtain wall components off site and then ship the complete unitized panel onsite for an easy quick installation on to the building.

The dynamic, thermally insulating and sealing system of the present invention is also for acoustically insulating and sealing of a safing slot of a curtain wall structure. The material used for insulating and sealing may be of a sound resistant and/or air tight material, such as an elastomeric interlaced foam based on synthetic rubber (e.g. Armaprotect® or Armaflex® from Armacell®), a polyethylene foam, a polyurethane foam, a polypropylene foam or a polyvinyl chloride foam.

While the invention is particularly pointed out and distinctly described herein, a preferred embodiment is set forth in the following detailed description, which may be best understood when read in connection with the accompanying drawings.

FIG. 1 shows a side cross-sectional view of an embodiment of the dynamic, thermally insulating and sealing system between the outer edge of a floor and the interior wall surface of a glass curtain wall construction when initially installed and attached to a horizontal framing member (transom at floor level, i.e. zero spandrel) in an unitized curtain wall construction, wherein the vision glass extends to the finished floor level below. In particular, the dynamic, thermally insulating and sealing system 100 is initially installed in the area of a zero spandrel area of a glass curtain wall construction, defined by an interior wall surface 1 including one or more framing members, i.e., vertical framing member—mullion 2—and horizontal framing member—transom 3—which is located at the floor level, and at least one floor 4 spatially disposed from the interior wall surface 1 of the curtain wall construction defining a safing slot 5 extending between the interior wall surface 1 of the curtain wall construction and an outer edge 6 of the floor 4. The framing members 2 and 3 are infilled with vision glass 7 extending to the finished floor level below. The dynamic, thermally insulating and sealing system 100 of the present invention has a tubular sealing element 8 comprising a top side cover 9 and a bottom side cover 10 which together surround a thermally resistant flexible foam material 11. The foam material is an intumescent foam material on a polyurethane base with a certain percentage of fire-protective additive materials, preferably blowing graphite. During an event of a fire, the intumescent materials will create an ash crust which will provide the fire protective function. The foam composition can be adjusted i.e. density, firestop filler percentage, etc. so that the necessary fire protective function is provided to the safing slot. Preferably, the tubular sealing element 8 has an approximately rectangular cross section with an upper surface 12, a lower surface 13 being arranged approximately in parallel to each other and a first side surface 14 and a second side surface 15 being arranged approximately in parallel to each other. Preferably, the top side cover 9 is a top side laminate 9, which builds the upper surface 12, whereas the bottom side cover 10 preferably is a bottom side laminate 10, which builds the lower surface 13 and both side surfaces 14 and 15. The thermally resistant flexible foam material 11 is enclosed from the top side cover 9 and the bottom side cover 10, wherein the thermally resistant flexible foam material 11 is connected to inner surfaces of the top side cover 9 and of the bottom side cover 10. When mounted, the first side surface 14 of the tubular sealing element 8 is adjacent to the outer edge 6 of the floor 4 and the second side surface 15 is adjacent to the interior wall surface 1 of the curtain wall construction preferably adjacent to the insulation positioned in a zero-spandrel area 17 of the curtain wall construction. The upper surface 12 of the mounted tubular sealing element 8 is flush with the upper surface 18 of the floor 4. In the present embodiment the tubular sealing element 8 has a smaller height than the floor 4, wherein the height of the tubular sealing element 8 is preferably about half of the height of the floor 4.

Figure 5:
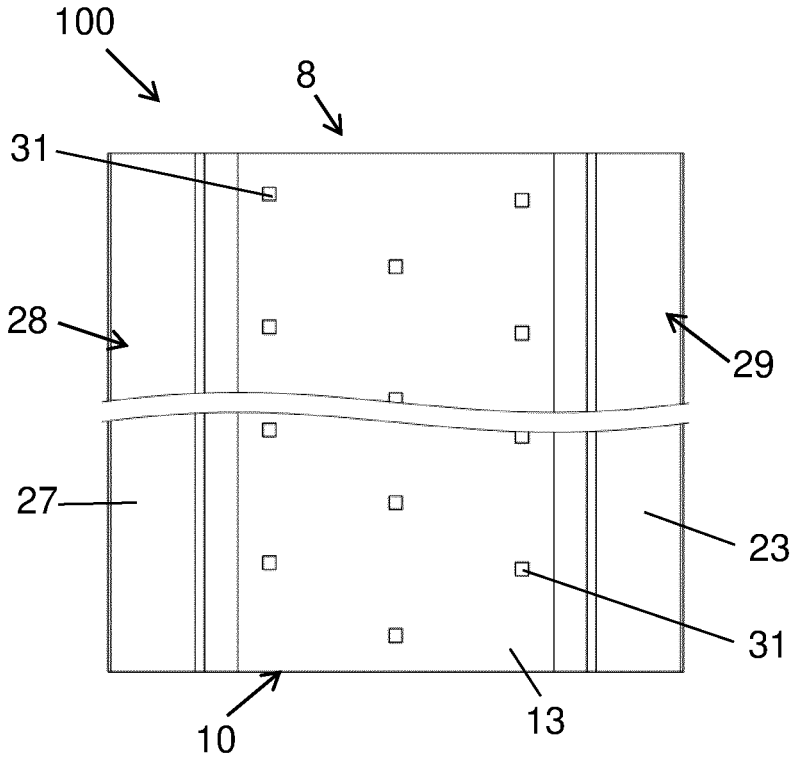
FIG. 5 shows the bottom view of the tubular sealing element of FIGS. 3 and 4, wherein the bottom side cover comprises several openings.

FIG. 2 to FIG. 5 show the structure of the tubular sealing element 8 in more detail. The top side laminate 9 as well as the bottom side laminate 10 of the embodiment shown in FIG. 2 each preferably comprise three layers. The bottom side laminate 10 comprises two layers 20, 21 of a plastic foil i.e. a combustible polyethylene, polypropylene or the like and a reinforced mesh layer 22, i.e. a glass fiber mesh laminated between the layers 20 and 21 of combustible foil. Preferably, layers 20 and 21 are polyethylene layers with the mesh layer 22 or a grid laminated between layer 20 and layer 21. The reinforced mesh layer 22 is used to retain the foam material 11 in place once it has been activated during a fire event. An ash crust, which is built by the foam material 11 during a fire event provides the fire protective function. The top side laminate 9 comprises an inner layer 24 and an outer layer 25 wherein at least one layer 24, 25 can comprise or can be made of aluminum, whereas one layer 24, 25 can comprise or can be made of a plastic foil i.e. a combustible polyethylene, polypropylene or the like. Further, the top side laminate 9 comprises a reinforced mesh layer 26 laminated between the layers 24 and 25. In a preferred embodiment, the outer layer 25 of the top side laminate 9 is an aluminum foil and the inner layer 24 of the top side laminate 9 is a a polyethylene foil, with the glass fibre mesh layer 26 laminated in between. The grid sizes of the mesh layer 22 of the bottom side laminate 10 and of the mesh layer 26 of the top side laminate 9 might be similar or can differ from each other, wherein the mesh layers 22 and 26 preferably have a mesh size of about 5 mm×5 mm For attaching the dynamic, thermally insulating and sealing system 100 to the outer edge 6 of the floor 4 and to the interior wall surface of the curtain wall construction the tubular sealing element 8 comprises a first connection area 28 and a second connection area 29. Each connection area 28, 29 preferably is constructed jointly by the top side cover 9 and the bottom side cover 10 being attached to each other planar in the first connection area 28 and in the second connection area 29. The connection areas 28, 29, or tabs, project from a corner of the tubular sealing element 8, in which the upper surface 12 of the top side cover 9 is connected to the first side surface 14 or the second side surface 15 of the bottom side cover 10, respectively. The wing-like connection areas 28, 29 are flexibly movable relative to the rectangular main shape of the tubular sealing element 8 and can be swiveled about approximately 270°. On a lower side of each connection areas 28, 29 an adhesive layer 23, 27 is arranged, which may extend over the entire length of the lower sides of the connection areas 28, 29 or which just might cover a part of the lower sides of the connection areas 28, 29. The adhesive layers 23, 27 are used to adhere the tubular sealing element 8 to the interior wall surface of the curtain wall construction and to the outer edge 6 of the floor 4. Further, the adhesive layers 23, 27 will hold the tubular sealing element 8 in place and ensure sealing against water and sound. During a fire event, minimal adhesion will remain intact. The adhesives are located on the tabs 28, 29 so that it can provide an instant rain resistant protection as well as ease of installation for the curtain wall constructor. The first connection area 28 is for attaching the tubular sealing element 8 to the curtain wall structure, wherein the lower side of the connection area 28 might be attached to the interior wall surface 1 of the curtain wall structure for example in the area of the transom 3. In a mounted position of the dynamic, thermally insulating and sealing system 100 the first connection area 28 is aligned with the interior wall surface 1 and approximately vertically arranged. The second connection area 29 is for attaching the tubular sealing element 8 to the upper surface 18 of the floor 4. In a mounted position of the dynamic, thermally insulating and sealing system 100 the second connection area 29 is aligned with the upper surface 18 of the floor and approximately horizontally arranged. As can be seen in FIG. 5 the bottom side laminate 10 comprises a large number of regularly or irregularly distributed openings 31 or perforations for water transfer from the foam material 11 through the bottom side laminate 10 to an outer side of the dynamic, thermally insulating and sealing system 100 in case there is an infiltration of water to the system. Preferably, the openings 31 are arranged in three rows.

Figure 6:
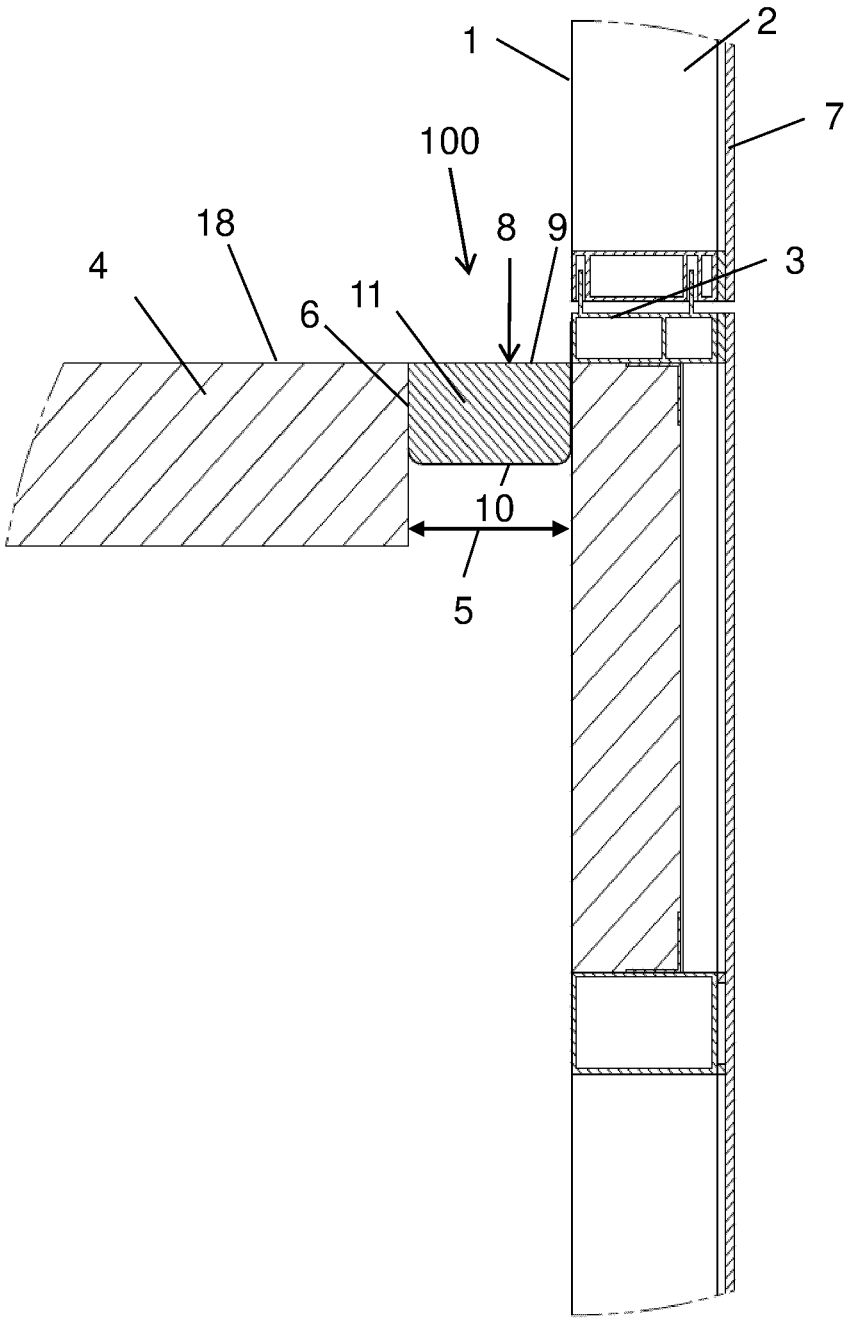
FIG. 6 shows a side cross-sectional view of an embodiment of the dynamic, thermally insulating and sealing system with the tubular sealing element arranged between the outer edge of a floor and the interior wall surface of a standard curtain wall construction.

FIG. 6 shows the application of the above described dynamic, thermally insulating and sealing system 100 with the tubular sealing element 8 within a standard curtain wall construction, wherein the tubular sealing element 8 is arranged between the outer edge 6 of a floor 4 and the interior wall surface 1 of a standard curtain wall construction.

Figure 7:
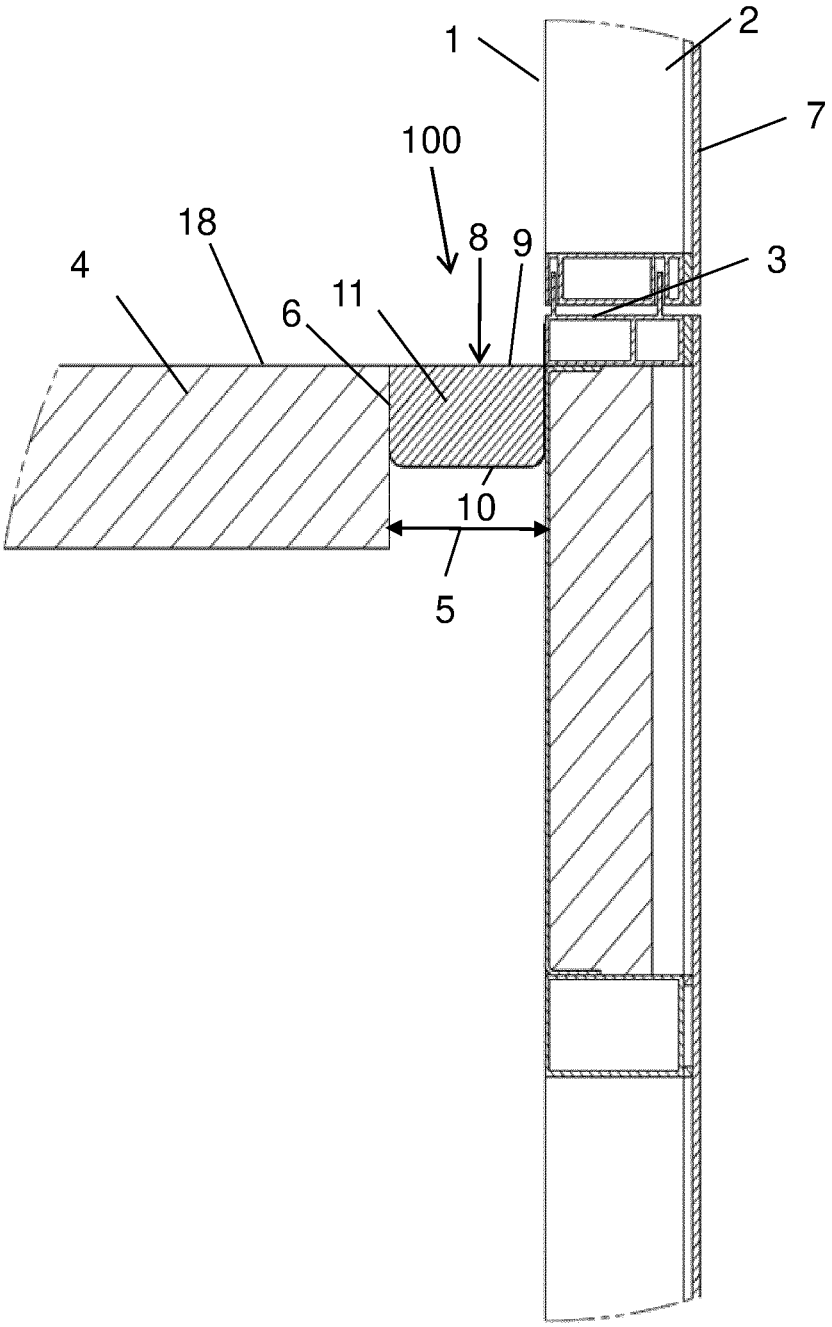
FIG. 7 shows a side cross-sectional view of an embodiment of the dynamic, thermally insulating and sealing system with the tubular sealing element arranged between the outer edge of a floor and the interior wall surface of a curtain wall construction having a steel back pan design.

FIG. 7 shows the application of the above described dynamic, thermally insulating and sealing system 100 with the tubular sealing element 8 with a curtain wall construction having steel back pan design, wherein the tubular sealing element 8 is arranged between the outer edge 6 of a floor 4 and the interior wall surface 1 of the curtain wall construction in steel back pan design.

Figure 8:
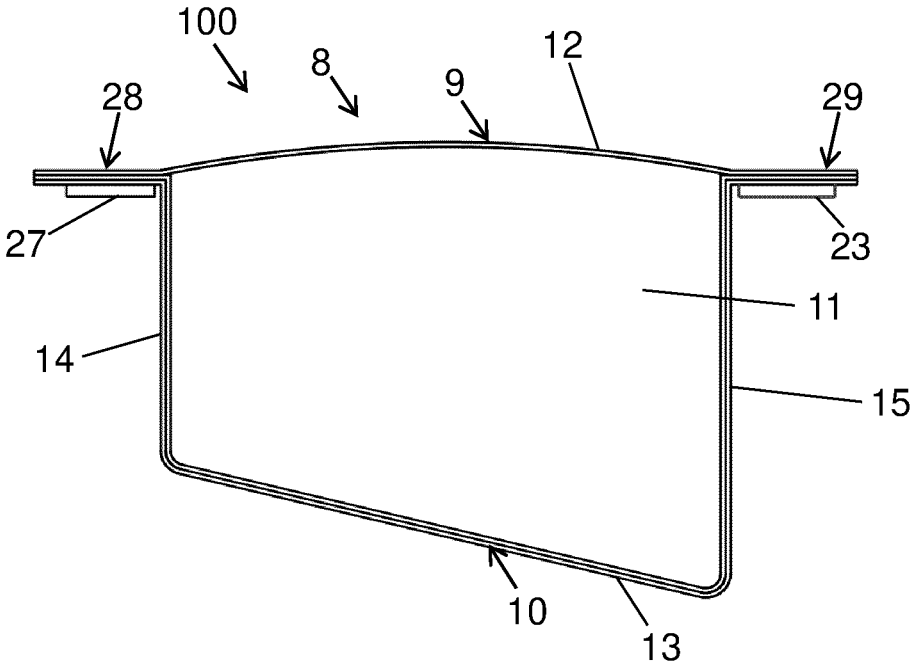
FIG. 8 shows a side cross-sectional view of another embodiment of the tubular sealing element having a trapezoidal cross section and a convex top side cover.

FIG. 8 shows another embodiment of the tubular sealing element with an alternative shape. The tubular sealing element 35 has a trapezoidal shape and a convex top surface. During fire tests, this tubular sealing element design also ensures complete seal of the safing slot due to its shape. The tubular sealing element 35 has a trapezoidal shape, whereby the curtain wall side will have a thicker profile compared to the floor side. For example, the tubular sealing element 35 might have a thickness of 3.5 inches on the curtain wall side and a thickness of 2.375 inches on the floor side.

FIG. 8 shows a side cross-sectional view of another embodiment of the tubular sealing element having a trapezoidal cross section and a convex top side cover.

It should be appreciated that these embodiments of the present invention will work with many different types of insulating materials used for the tubular sealing element as long as the material has effective high temperature insulating and water-proofing characteristics.

The dynamic, thermally insulating and sealing system of the present application has been subject to a test according to standard method ASTM E 2307, Standard Test Method for Determining Fire Resistance of Perimeter Fire Barriers Using Intermediate-Scale, Multi-story Apparatus, 2015, and to a test according to standard method ASTM Designation: E 1399-97 (Reapproved 2005), Standard Test Method for Cyclic Movement and Measuring the Minimum and Maximum Joint Widths of Architectural Joint Systems, as follows:

Elements and Assembly Description

The dynamic, thermally insulating and sealing system of the present application has been tested with curtain wall structures having a common curtain wall design including foil-faced curtain wall insulation, a steel back pan design or which include glass, especially vision glass extending to the finished floor level below. Following, the application of the dynamic, thermally insulating and sealing system of the present application with a glass curtain wall structure is given. The dynamic, thermally insulating and sealing system of the present application has been tested in the largest possible safing slot, i.e. having a joint width of 5 inch (127 mm).

1. Concrete Floor Assembly (Floor, 2-Hour Fire-Rating):

2 hour rated concrete floor assembly made from either lightweight or normal weight concrete with a density of 100 to 150 pcf, having a min. thickness of 4½ inch at the joint face. There was a 5 inch open joint (safing slot) from wall to slab.

2. Curtain Wall (Non Fire-Rated, 0 Hours Fire-Rated):

Curtain wall constructed of rectangular hollow tubing with a min. dimension of 2½ inch wide and 4 inch deep (total depth of wall including min. ¼ inch glass and min. ½ inch aluminum cap is min. 5¼ inch), made from min. 0.1 inch thick aluminum (framing members). A min. of ¼ inch thick clear, heat strengthened or tempered glass (vision glass) was installed in place with aluminum compression plates (caps) and glazing gaskets.

3. Spandrel Angles:

Min. 22 GA 2 inch×2 inch galvanized steel angles installed around perimeter of spandrel. Positioning so that the curtain wall insulation, when placed flush against the back surface of the angle, is flush with the internal surface of the vertical framing members. Securing of the angle to the underside of the upper transom as well as the vertical members with min. ¾ inch No. 10 self-tapping sheet metal screws spaced a max. 8 inch oc. Steel angles to overlap in each corner and be secured together with two sheet metal screws.

4. Curtain Wall Insulation:

All spandrel panels were insulated with a min. 3 inch thick, 8 pcf, mineral wool curtain wall insulation, faced on one side with aluminum foil scrim (vapor retarder) which is exposed to the room interior. Insulation was tightly fitted between vertical framing members and secured to spandrel angles with steel screws or impaling pins, and steel clinch shields placed a max. 12 in. oc. Min. 3 screws required on vertical angles. All meeting edges of insulation with aluminum framing members were sealed with nom. 4 inch wide pressure sensitive aluminum foil faced tape centered over the junction.

5. Framing Covers (Optional):

If desired, strips made of min. 2 in. thick×8 in. wide, 8 pcf, mineral wool curtain wall insulation are installed, faced on one side with aluminum foil scrim (vapor retarder) which is exposed to the room interior. Framing covers are centered over each vertical framing member and secured to spandrel angles with steel screws or impaling pins, and steel clinch shields and clips spaced min 10 in. oc. Framing covers are butted to the bottom surface of the perimeter joint treatment.

6. Safing Slot Insulation Material (Perimeter Joint Protection):

The dynamic, thermally insulating and sealing system, in particular the tubular sealing element of the invention was positioned into the perimeter joint such that the top surface of the element is flush with the top surface of the concrete floor. Paper from the adhesive has been removed and the tabs (wings) have been adhered to top side of concrete floor and front face of the mullion. Splices (butt joints) were tightly compressed together (approximately ⅛ inch).

7. Mounting Attachment:

Attach aluminum framing to the structure framing according to the curtain wall manufacturer's instructions connect the mounting attachments to the joint face of the concrete floor assembly according to the curtain wall manufacturer's instructions.

8. Joint Cover:

After perimeter joint protection is installed an architectural joint cover, installed per curtain wall manufacturer's instructions, may be used to completely cover the joint.

Testing and Evaluation Methods

1. ASTM E 2307:

Instrumentation:

Thirty-five (35) 24 GA, Type K, fiberglass jacketed thermocouples (TCs) were installed in compliance with the standard: 12 TCs measured the temperature up to the center of the exterior, 11 TCs measured the temperatures on the perimeter joint and the supporting frame, and 12 TCs measured furnace temperatures. The output of the thermocouples was monitored by a 100-channel Yokogawa, Inc., Darwin Data Acquisition Unit. The computer was programmed to scan and save data every 15 seconds.

Test Standard:

Testing was conducted in accordance with the applicable requirements, and following the standard method of ASTM E 2307, Standard Test Method for Determining Fire Resistance of Perimeter Fire Barriers Using Intermediate-Scale, Multi-story Apparatus, 2015.

The assembly was secured to the test laboratory's Intermediate-Scale, Multi-story Test Apparatus (ISMA), with ceramic fiber insulation installed between the assembly and the furnace to create an effective seal. The window burner was centered on the vertical centerline of the window, 9 inch below the top of the opening, and with the longitudinal centerline of the burner 3 inch from the plane of the exterior wall, consistent with the standard and the calibration of the test apparatus. The assembly was tested using commercial grade propane gas at the flow rates determined during calibration of the apparatus.

2. ASTM E 1399:

Instrumentation:

A welded steel testing apparatus in combination with hydraulic cylinders, was used to cycle the test specimen to a specified maximum and minimum joint width and with the required number of continuous repetitious movements, in accordance to the desired movement classification. The joint width displacement output was calibrated with predetermined hardware locations and monitored to an accuracy of 0.25±0.013 mm (0.010±0.005 in.).

Test Standard:

Testing was conducted in accordance with the applicable requirements, and following the standard method of ASTM Designation: E 1399-97 (Reapproved 2005), Standard Test Method for Cyclic Movement and Measuring the Minimum and Maximum Joint Widths of Architectural Joint Systems.

The assembly was secured to the test laboratory's Intermediate-Scale, Multi-story Test Apparatus (ISMA), with a combination of various hardware and threaded rods. The hydraulic cylinders were centered with the assembly so that a consistent and uniform load distribution was applied to the testing specimen. The hydraulic cylinders were attached to the predetermined locations on the ISMA to accomplish the desired movement classes in the vertical and horizontal directions.

Cycling was performed by applying a minimum number of cycles 100 with cycling rates greater or equal to 30 cpm followed by a minimum number of cycles 400 with cycling rates greater or equal to 10 cpm, to comply with the requirements for a class IV movement rating.

Results

The test assembly as described achieved an F-Rating of 120 min as well as a movement rating of class IV.

It has been shown, that the dynamic, thermally insulating and sealing system of the present invention for sealing between the edge of a floor and an interior wall surface of a curtain wall construction maintains sealing of the safing slots surrounding the floor of each level in a building.

It has been demonstrated that the dynamic, thermally insulating and sealing system, in particular for a glass curtain wall structure, of the present invention is capable of meeting or exceeding existing fire test and building code requirements including existing exceptions. Additionally, maintaining safing insulation between the floors of a residential or commercial building and the exterior curtain wall responsive to various conditions including fire exposure is guaranteed.

Further, it has, in particular, been shown, that the dynamic, thermally insulating and sealing system of the present invention meets the requirements of a full-scale ASTM E 2307 as well as full-scale ASTM E 1399 tested system for floor assemblies where the vision glass extends to the finished floor level, addressing the code exception, avoiding letters and engineering judgments and securing and providing defined/tested architectural detail for this application, in particular providing a tested system for fire- and movement-safe architectural compartmentation.

The tested system according to the present invention can be installed from one side, implementing a one-sided application.

Further, the dynamic, thermally insulating and sealing system of the present application can be easily mounted with a low compression in different sizes of safing slots as it is provided in different sizes, nevertheless providing optimal fire resistance.

It has also been shown, that the system can be employed in a stick-built exterior dynamic curtain wall façade or used in assembling a unitized panel for use within an exterior dynamic curtain wall.

Further, a system is provided that has improved fire-resistance as well as sound-resistance, and has at the same time enhanced water-stopping properties and can be easily integrated during installation of the curtain wall structure. Further, the provided fire-resistance-rated thermally insulating and sealing system additionally addresses water infiltration as well as inhibition of water transfer within the building structures and enhancement of water-tightness of the safing slot sealing system.

It has been also shown that a building construction is provided comprising such a dynamic, thermally insulating and sealing system for effectively thermally insulating and sealing of the safing slot between a curtain wall structure and the edge of a floor.

As such, the dynamic, thermally insulating and sealing system of the present invention provides a system for effectively maintaining a complete seal in a safing slot when utilizing a curtain wall construction, especially a glass curtain wall construction, vision glass extends to the finished floor level below.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A tubular sealing element for insulating and sealing, the tubular sealing element comprising:

a thermally resistant flexible foam material;

a bottom side cover:

a top side cover, connected at two positions, spatially disposed from each other, to the bottom side cover, wherein the bottom side cover and the top side cover together surround the thermally resistant flexible foam material;

a first connection area configured for attaching the tubular sealing element to an interior wall surface of a curtain wall construction;

a second connection area configured for attaching the tubular sealing element to an outer edge of a floor;

at least one adhesive layer configured for fixing the tubular sealing element to the curtain wall construction; and wherein the bottom side cover and the top side cover are configured to allow compression of the thermally resistant flexible foam material between the interior wall surface and the outer edge of the floor during installation.

2. The tubular sealing element of claim 1, wherein the bottom side cover and the top side cover overlap over at least a portion of the first connection area, and wherein the bottom side cover and the top side cover overlap over at least a portion of the second connection area.

3. The tubular sealing element of claim 1 wherein the first connection area and the second connection area each constitute parts of the bottom side cover and the top side cover.

4. The tubular sealing element of claim 1, wherein the top side cover is a top side laminate comprising at least two layers and wherein the bottom side cover is a bottom side laminate comprising at least two lavers.

5. The tubular sealing element of claim 4, wherein the bottom side laminate comprises a reinforced plastic foil layer.

6. The tubular sealing element of claim 4, wherein the top side laminate comprises a reinforced aluminum foil layer.

7. The tubular sealing element of claim 4, wherein the top side laminate comprises a mesh layer made of a glass fiber material or a ceramic fiber material and wherein the bottom side laminate comprises a mesh layer made of a glass fiber material or a ceramic fiber material.

8. The tubular sealing element of claim 7, wherein the mesh layer of top side laminate has a different mesh size compared to the mesh layer of the bottom side laminate.

9. The tubular sealing element of claim 1, wherein a lower side of the first connection area is configured for attaching the tubular sealing element to the interior wall surface of the curtain wall construction and a lower side of the second connection area is configured for attaching the tubular sealing element to a top surface of the floor.

10. The tubular sealing element of claim 1, wherein the tubular sealing element is configured for positioning into a safing slot between the interior wall surface and the floor, so that the top side cover is flush with a top surface of the floor.

11. The tubular sealing element of claim 1, wherein the at least one adhesive layer is on the first connection area and/or on the second connection area.

12. The tubular sealing element of claim 1, wherein the thermally resistant flexible foam material is an intumescent, open-celled foam material comprising a fire-protective additive.

13. The tubular sealing element of claim 1, wherein the thermally resistant flexible foam material has a density in uncompressed state of 90 $kg/m^3$.

14. The tubular sealing element of claim 1, having a cross-sectional shape which is generally rectangular, trapezoidal, circular, or U-shaped.

15. The tubular sealing element of claim 1, wherein the bottom side cover comprises openings or perforations fir water transfer from an inner side of the tubular sealing element to the outside.

16. The tubular sealing element of claim 1, wherein the tubular sealing element has a width of about 3.54 inches (about 90 mm) in a cross-sectional view, a width of about 4.53 inches (about 115 mm) in a cross-sectional view, or a width of about 5.55 inches (about 141 mm) in a crass-sectional view.

17. A dynamic, thermally insulating and sealing system for effectively thermally insulating and sealing of a safing slot within a building construction having a curtain wall construction defined by an interior wall surface including at least one vertical and at least one horizontal framing member and at least one floor spatially disposed from the interior wall surface of the curtain wall construction defining the safing slot extending between the interior wall surface of the curtain wall construction and an outer edge of the floor, the system comprising the tubular sealing element of claim 1.

18. A building construction having a curtain wall construction defined by an interior wall surface including one or more framing members and at least one floor spatially disposed from the interior wall surface of the curtain wall construction defining the safing slot extending between the interior wall surface of the curtain wall construction and an outer edge of the floor, comprising the dynamic, thermally insulating and sealing system of claim 17.

19. The building construction according to claim 18, wherein the curtain wall construction is a glass curtain wall construction or a curtain wall construction having a steel back pan design or a common curtain wall construction including foil-faced curtain wall insulation.

* * * * *